US009418780B2

(12) United States Patent
Oikawa et al.

(10) Patent No.: US 9,418,780 B2
(45) Date of Patent: Aug. 16, 2016

(54) MAGNETIC COMPOSITE MATERIAL

(71) Applicant: SAMSUNG ELECTRONICS CO., LTD., Suwon-si, Gyeonggi-do (KR)

(72) Inventors: Tadaaki Oikawa, Yokohama (JP); Kotaro Hata, Yokohama (JP)

(73) Assignee: SAMSUNG ELECTRONICS CO., LTD. (KR)

( * ) Notice: Subject to any disclaimer, the term of this patent is extended or adjusted under 35 U.S.C. 154(b) by 164 days.

(21) Appl. No.: 14/098,979

(22) Filed: Dec. 6, 2013

(65) Prior Publication Data

US 2014/0158929 A1 Jun. 12, 2014

(30) Foreign Application Priority Data

Dec. 6, 2012 (JP) ..... 2012-266825
Aug. 28, 2013 (KR) ..... 10-2013-0102490

(51) Int. Cl.
*H01F 1/00* (2006.01)
*H01F 1/26* (2006.01)

(52) U.S. Cl.
CPC ..... *H01F 1/26* (2013.01)

(58) Field of Classification Search
CPC ..... H01F 1/28
See application file for complete search history.

(56) References Cited

U.S. PATENT DOCUMENTS

| | | | |
|---|---|---|---|
| 6,908,960 | B2 | 6/2005 | Takaya et al. |
| 6,972,097 | B2 | 12/2005 | Yoshida et al. |
| 7,060,350 | B2 | 6/2006 | Takaya et al. |
| 2002/0039667 | A1 | 4/2002 | Takaya et al. |
| 2004/0108486 | A1 | 6/2004 | Yoshida et al. |
| 2010/0000769 | A1 | 1/2010 | Ohmi et al. |
| 2011/0017501 | A1 | 1/2011 | Ohmi et al. |
| 2012/0273417 | A1 | 11/2012 | McGinnis et al. |
| 2013/0140076 | A1 | 6/2013 | Lee et al. |

FOREIGN PATENT DOCUMENTS

| | | | |
|---|---|---|---|
| EP | 1986200 | * | 10/2008 |
| JP | 2001107104 | A | 4/2001 |
| JP | 2001303102 | A | 10/2001 |
| JP | 2008181905 | A | 8/2008 |
| JP | 2008263098 | A | 10/2008 |
| JP | 2008311255 | A | 12/2008 |
| JP | 2009249673 | A | 10/2009 |
| JP | 2010225387 | A | 10/2010 |
| JP | 2011096923 | A | 5/2011 |
| JP | 2012077316 | A | 4/2012 |
| JP | 2012-134463 | * | 7/2012 |
| JP | 2012134463 | A | 7/2012 |
| KR | 100267358 | B1 | 10/2000 |
| KR | 100533097 | B1 | 11/2001 |
| KR | 100606355 | B1 | 8/2003 |
| KR | 1020090103951 | A | 10/2009 |
| KR | 1020110018870 | A | 2/2011 |
| KR | 101066074 | B1 | 9/2011 |
| WO | 9704469 | A1 | 2/1997 |

OTHER PUBLICATIONS

Translation of JP 2012-134463, Jul. 12, 2012.*

* cited by examiner

*Primary Examiner* — Carol M Koslow
(74) *Attorney, Agent, or Firm* — Cantor Colburn LLP

(57) ABSTRACT

A magnetic composite material including a dielectric material and magnetic metal particles in the dielectric material, wherein and a real part μ' of a complex permeability is greater than about 1 at a frequency of about 3 gigahertz (GHz), and the loss tangent tan δ is less than or equal to about 0.1.

18 Claims, 3 Drawing Sheets

MAGNETIC COMPOSITE MATERIAL

CROSS-REFERENCE TO RELATED APPLICATION

This application claims priority to and the benefit of Japanese Patent Application No. 2012-266825, filed in the Japanese Patent Office on Dec. 6, 2012, and Korean Patent Application No. 10-2013-0102490, filed in the Korean Intellectual Property Office on Aug. 28, 2013, and all the benefits accruing therefrom under 35 U.S.C. §119, the contents of which are incorporated herein by reference in their entirety.

BACKGROUND

1. Field

The present disclosure relates to a composite material containing a magnetic substance. Particularly, the present disclosure relates to a composite material for a high frequency electronic device for operation in a gigahertz frequency domain.

2. Description of the Related Art

Recently, usable frequencies have been rapidly changed to high frequencies for electronic devices, such as communication devices, and the like. For example, a communication device such as a mobile phone uses a frequency domain of greater than or equal to about 1 gigahertz (GHz), and a multiband communication system is increasingly used to provide a plurality of communication methods. Accordingly, the electronic components mounted in such devices are desirably responsive to the gigahertz frequencies and broadband.

Thus there remains a need for an improved magnetic material.

SUMMARY

Disclosed is a magnetic composite material including: a dielectric material; and magnetic metal particles in the dielectric material, wherein a real part μ' of a complex permeability of the magnetic composite material is greater than about 1 at a frequency of 3 gigahertz, and a loss tangent tan δ of the magnetic composite material is less than or equal to about 0.1.

Also disclosed is method of manufacturing a magnetic composite material, the method including: contacting magnetic metal particles and a dielectric material to form a dispersion of the magnetic metal particles in the dielectric material to manufacture the magnetic composite material, wherein a real part μ' of a complex permeability of the magnetic composite material is greater than about 1 at a frequency of 3 gigahertz, and a loss tangent tan δ of the magnetic composite material is less than or equal to about 0.1.

Also disclosed is an electronic device including the magnetic composite material.

Also is disclosed is method of selecting a complex permeability and a loss tangent of a magnetic composite material, the method including: selecting a magnetic metal particle having an aspect ratio of about 1.5 to about 20, wherein the aspect ratio is a major axis length divided by a minor axis length; and combining the magnetic metal particle with a dielectric material to select a complex permeability and a loss tangent of the magnetic composite material.

BRIEF DESCRIPTION OF THE DRAWINGS

The above and other aspects, advantages, and features of this disclosure will become more apparent by describing in further detail exemplary embodiments thereof with reference to the accompanying drawings, in which.

Figure 1:
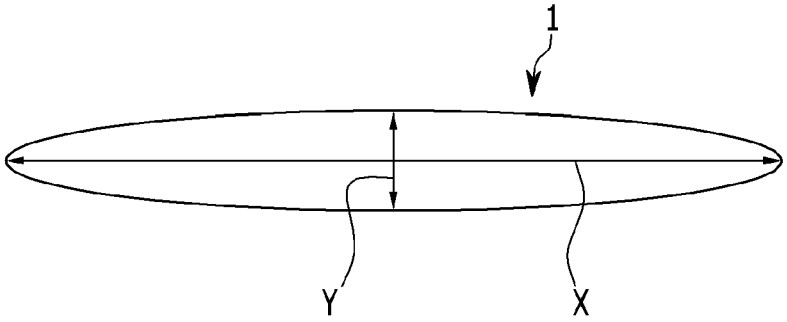
FIG. 1 is a schematic view showing an embodiment of a metal particle.

Hereinafter, an embodiment is disclosed in further detail with respect to examples. However, the present disclosure is not limited to the following examples.

DETAILED DESCRIPTION

In order to provide a composite material for high frequency electronic components, magnetic particles can be included a composite material to impart an anisotropic magnetic field. The composite material can be made to have isotropy by mixing and dispersing flat magnetic particles in an insulating material and mechanically or magnetically processing the material to align the magnetic particles in a selected direction. However, available materials produced using this method are not suitable for frequencies greater than about 1 GHz, thus leaving a need for an improved material.

Disclosed is a magnetic composite material that provides a significant functional improvement and is suitable for electronic devices, e.g., communication devices, or the like, with significant improvement in the high frequency domain. This disclosure relates to a magnetic composite material which functions in the high frequency domain.

Also disclosed is a material in which metal particles are dispersed in the composite material to provide an anisotropic material.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers, and/or sections, these elements, components, regions, layers, and/or sections should not be limited by these terms. These terms are only used to distinguish one element, component, region, layer, or section from another element, component, region, layer, or section. Thus, "a first element," "component," "region," "layer," or "section" discussed below could be termed a second element, component, region, layer, or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise.

"Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

"Alkyl" as used herein means a straight or branched chain, saturated, monovalent hydrocarbon group (e.g., methyl or hexyl).

"Alkoxy" means an alkyl group that is linked via an oxygen (i.e., alkyl-O—), for example methoxy, ethoxy, and sec-butyloxy groups.

A magnetic composite material comprises a dielectric material; and magnetic metal particles in the dielectric material, wherein a real part μ' of a complex permeability of the magnetic composite material is greater than about 1 at a frequency of 3 gigahertz ("GHz"), and a loss tangent tan δ of the magnetic composite material is less than or equal to about 0.1.

In the magnetic composite material, the magnetic metal particles are dispersed in the dielectric material. In the magnetic composite material, a real part μ' of the complex permeability of the magnetic composite material is greater than about 1 at a frequency of 3 GHz, and a loss tangent tan δ of the magnetic composite material is less than or equal to about 0.1. The real part μ' of the complex permeability may be about 1 to about 5, and for example, about 1 to about 3. In addition, the loss tangent tan δ may be about 0.01 to about 0.1, and for example, about 0.01 to about 0.05.

The magnetic metal particles are not particularly limited as long as the obtained composite material has a physical properties suitable to provide a real part μ' of the complex permeability of greater than about 1 at a frequency of 3 GHz frequency, and a loss tangent tan δ of less than or equal to about 0.1.

According to an embodiment, the magnetic metal particles have a needle shape. FIG. 1 is a schematic view showing an embodiment of shape of a metal particle 1 having a major axis X of the metal particle and a minor axis Y of the metal particle.

The term "needle shape" means a shape having an aspect ratio of a major axis length to a minor axis length of the magnetic metal particle of greater than or equal to about 1.1. The needle-shaped metal particle may have an aspect ratio (major axis length/minor axis length) of about 1.5 to about 20, for example, about 1.5 to about 15. When the aspect ratio is over about 20, the integrity of the needle-shaped metal particle may be deteriorated. In addition, when the aspect ratio is over about 20 the resonance frequency may be increased too much to obtain sufficient magnetic permeability. In addition, when the aspect ratio is less than about 1.1, the desirable resonance frequency may not be obtained.

Figure 2:
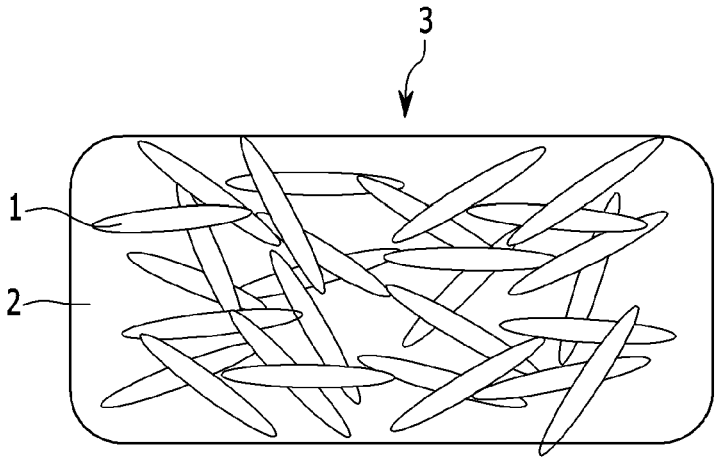
FIG. 2 is a schematic view showing an embodiment of a magnetic composite material.

The metal particle 1 may be dispersed in a dielectric material 2 to provide a magnetic composite material 3 as shown in FIG. 2.

Figure 3:
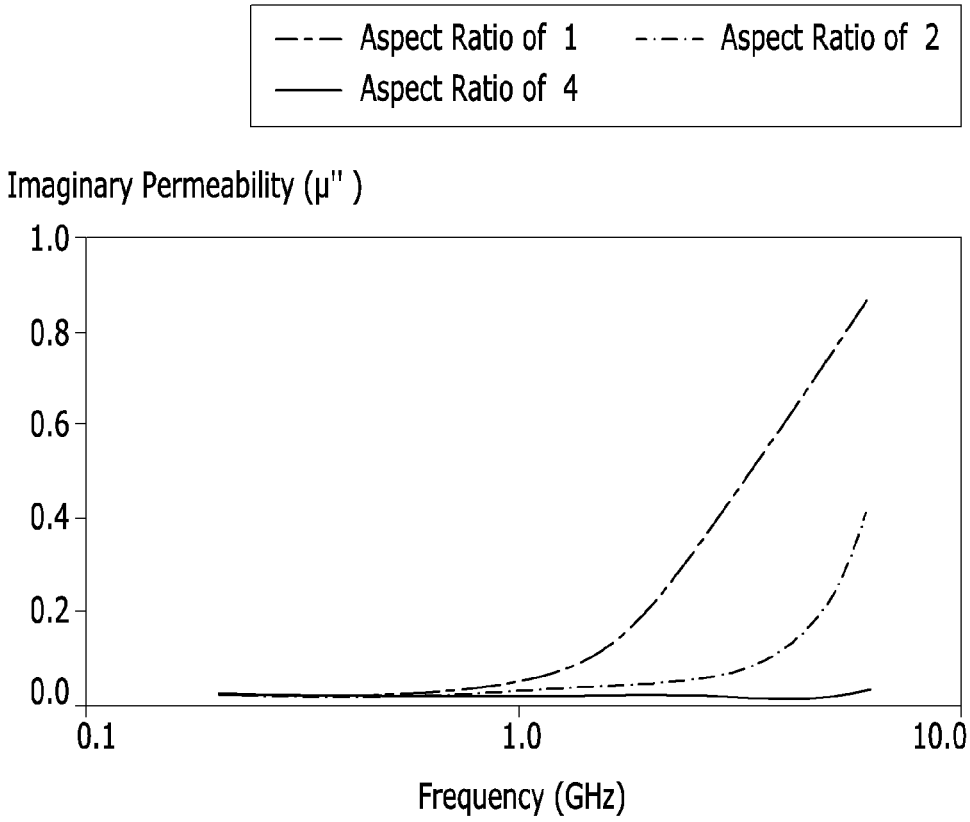
FIG. 3 is a graph of the imaginary part μ" of permeability (arbitrary units) versus frequency (gigahertz, GHz) that shows the frequency dependency of the imaginary part μ" of the permeability based an aspect ratio of metal particles.

A needle-shaped metal particle having the selected aspect ratio is preferable since the magnetic loss is decreased in the high frequency domain. FIG. 3 shows the frequency dependency of the magnetic loss versus the aspect ratio of the particle. The imaginary part of magnetic permeability when the frequency is changed in the metal particles having an aspect ratio of about 1, about 2, and about 4 is shown in FIG. 3.

As shown in FIG. 3, when the frequency is less than about 1.0 GHz, the imaginary part μ" of permeability is little changed in any aspect ratio. However, when the frequency is over about 1.0 GHz, the imaginary part μ" of permeability is sharply increased when using the metal particles having an aspect ratio of about 1.

On the other hand, even if the frequency is over about 1.0 GHz, when using the metal particles having an aspect ratio of about 2, the slope of the imaginary part μ" of permeability is smooth, and when the aspect ratio is about 4, the imaginary part μ" of permeability is little changed. In other words, the tendency is acknowledged that the magnetic loss at a high frequency domain is suppressed by as much as when using metal particles having a high aspect ratio.

While not wanting to be bound by theory, it is understood that the magnetic loss may be suppressed by dispersing needle-shaped metal particles having an aspect ratio of about 1.5 to about 20 in a dielectric material. Resultantly, the real part μ' of the complex permeability of the obtained magnetic composite material may be more than about 1, and the magnetic loss tan δ is suppressed to be less than or equal to about 0.1.

The aspect ratio range of metal particles used in the material may be determined using the following Equations 1 to 3.

The anisotropic magnetic field Ha of the metal particles is rapidly increased when increasing the aspect ratio. Accordingly, the effective magnetic field H represented by the following Equation 1 is increased when increasing the aspect ratio under the condition that other components are the same, in which Hex is the applied external field, Hdip is the internal dipolar field.

$$H=H\text{ex}+h(t)+H\text{dip}+Hd+Ha \quad \text{Equation 1}$$

The resonance frequency fr represented by the following Equation 2 may be increased when increasing the effective magnetic field H, wherein γ is the gyromagnetic constant.

$$fr=\gamma H/2\pi \quad \text{Equation 2}$$

According to an embodiment, the metal particles having an aspect ratio of about 1.5 to about 20 may increase the effective magnetic field H compared to the metal particles having an aspect ratio of less than about 1.5. Accordingly, in an embodiment, when using the metal particles having the selected aspect ratio, the resonance frequency of the obtained magnetic composite material may be increased, and improved magnetic characteristics may be imparted even at a high frequency.

The metal particles according to an embodiment may have a major axis length of about 10 to about 1000 nanometers (nm). For example, the metal particles may have a major axis length of about 20 to about 500 nm, or about 45 to about 260 nm.

Needle-shaped metal particles having a major axis length of less than about 10 nm are difficult to prepare, and the obtained magnetic characteristics are insufficient. When the major axis length is over 1000 nm, the magnetic loss is excessive due to an over-current in the obtained composite material.

The metal particles according to an embodiment may be metal particles having a primary component of iron or an iron-cobalt alloy, and for example, may contain about 90 to about 95 parts by mass of iron or an iron-cobalt alloy, based on 100 parts by mass of the metal particles.

The resonance frequency fr is represented by the following Equation 3.

$$(\mu-1)\times fr=\gamma Ms/2\pi \quad \text{Equation 3}$$

In Equation 3, μ refers to a magnetic permeability, γ refers to a gyromagnetic constant, and Ms is a saturation magnetic flux density.

According to Equation 3, the resonance frequency fr is increased and the magnetic permeability μ is decreased in the high frequency domain. Accordingly, when both the resonance frequency fr and the magnetic permeability μ are maintained to be high, a magnetic substance having a high saturation magnetic flux density Ms may be used. The disclosed material may comprise iron or an iron-cobalt alloy having a high saturation magnetic flux density Ms. Thereby, in the gigahertz frequency domain, high magnetic permeability may be maintained together with the effect of suppressing magnetic loss based on the shape anisotropy disclosed above.

The composition of the iron-cobalt alloy may comprise about 65 to about 75 atomic percent (atom %) iron and about 25 to about 35 atom % cobalt, and for example, about 66 to about 74 atomic % iron and about 26 to about 34 atomic % cobalt, or about 70 atom % iron and about 30 atom % cobalt.

According to an embodiment, by using needle-shaped metal particles having an aspect ratio of about 1.5 to about 20, the increase of the imaginary part μ" of the permeability in the frequency domain of at least about 3 GHz is suppressed, so the real part μ' of permeability may be increased to more than about 1. In addition, the loss tangent tan δ may be suppressed to less than or equal to about 0.1. Particularly, when the metal particles include a primary component of iron or an iron-cobalt alloy, the high magnetic permeability may be maintained in the high frequency domain.

In the embodiment, by using the selected needle-shaped metal particles, the selected magnetic characteristic may be provided regardless whether the metal particles are aligned in the dielectric material or not.

The dielectric material is not particularly limited as long as the dielectric material may uniformly mix with the magnetic metal particles.

For example, the dielectric material may include a thermoset, a thermoplastic, or a combination thereof. In an embodiment, the dielectric material comprises an epoxy resin, a silicone, a phenolic resin, a polyimide, a polybenzoxazole, a polyphenylene, a polybenzocyclobutene, a polyarylene ether, a polycyclohexane, a polyester, a fluoropolymer, a polyolefin, a polycycloolefin, a polycyanate, a polyphenylene ether, a polystyrene, a polyethylene, or the like, or a combination thereof. Use of a polyethylene is specifically mentioned.

According to an embodiment, the mixing ratio of the magnetic metal particles and the dielectric material is suitably determined within the range as long as the magnetic metal particles are uniformly dispersed in the dielectric material, and simultaneously, the magnetic characteristics of the obtained composite material are not undesirably degraded. A composition for forming the magnetic composite material may comprise the magnetic metal particle and the dielectric material, in which the magnetic metal particles may be included in an amount of about 25 to about 35 volume percent (volume %), and the dielectric material may be included in an amount of about 65 to about 75 volume %, or the magnetic metal particle may be included in an amount of about 26 to about 34 volume %, and the dielectric material may be included in an amount of about 66 to about 74 volume %, or for example, the magnetic metal particles may be included in an amount of about 30 volume % and the dielectric material included in an amount of about 70 volume %, each based on a total volume of the magnetic metal particles and the dielectric material in the composition for the magnetic composite material. The resulting magnetic composite material may comprise the magnetic metal particles in an amount of about 25 to about 35 volume % and the dielectric material may be included in an amount of about 65 to about 75 volume %, or the magnetic composite material may comprise the magnetic metal particles in an amount of about 26 to about 34 volume % and the dielectric material may be included in an amount of about 66 to about 74 volume %, or for example, the magnetic composite material may comprise the magnetic metal particles in an amount of about 30 volume % and the dielectric material in an amount of about 70 volume %, each based on a total volume of the magnetic metal particles and the dielectric material in the magnetic composite material.

The composition for the magnetic composite material, and the resulting composite material, may further include other components, such as a dispersing agent or a coupling agent and the like, other than the magnetic metal particles and the dielectric material, as long as the desirable magnetic characteristics are not undesirably degraded.

Representative dispersing agents include C12 to C18 fatty acids, alkali metal and alkaline earth metal soaps of the C12 to C18 fatty acid, a natural surfactant such as lecithin or cephalin, a synthetic surfactant possessing a polar group such as a group of the formula —$PO(OM)_2$, —$OPO(OM)_2$, —$SO_3M$, —$OSO_3M$, or —$NR_2$ wherein M is a hydrogen atom or a metal ion such as Li, Na, or K and R is a hydrogen atom or an alkyl group, for example. Representative fatty acids include myristic acid, oleic acid, lauric acid, palmitic acid, stearic acid, or behenic acid, for example. A combination comprising at least one of the foregoing dispersing agents may be used. The amount of the dispersing agent to be used herein is in the range between 1 and 5 parts by weight, based on 100 parts by weight of a composition for forming the composite material.

Representative coupling agents include a silane coupling agent or a titanium coupling agent, for example. The silane coupling agent may be of the formula $R_mSiY_n$, wherein R is a C1 to C6 alkyl group or a C1 to C6 alkoxy group, Y is an alkyl group, a vinyl group, a (meth)acrylic group, a phenyl group, an amino group, an epoxy group, or a mercapto group, n is 1 to 3, and m+n is 4.

Also, a solvent may be included in the composition. Representative solvents include an alcohol, toluene, methylisobutyl ketone, or methylethyl ketone, for example.

The composite material may be manufactured by a method comprising: contacting magnetic metal particles and a dielectric material to form a dispersion of the magnetic metal particles in the dielectric material to manufacture the magnetic composite material, wherein a real part μ' of a complex permeability of the magnetic composite material is greater than about 1 at a frequency of 3 gigahertz, and a loss tangent tan δ of the magnetic composite material is less than or equal to about 0.1.

The contacting may comprise contacting each component of the composite material using a suitable mixing device, such as a mixer, a roller, e.g., a two axis or a three axis roller, an agitator, or the like. The mixing of the raw materials may be performed until the magnetic metal particles are uniformly dispersed in the dielectric material. The mixing may be performed in any suitable order, and may be before or after curing of the composition. The mixing temperature may be selected considering ease of handling of the dielectric material or the like, and may be over the melting point of dielectric material. The obtained mixture may be press-molded while heating to provide a magnetic composite material.

The magnetic composite material according to an embodiment has a real part μ' of complex permeability of greater than about 1 at a frequency of about 3 GHz, and the loss tangent tan δ may be less than or equal to about 0.1 regardless of whether the magnetic metal particles are aligned in the selected direction or not in the process of preparing the same.

EXAMPLES

Example 1

Needle-shaped particles of an $Fe_{70}Co_{30}$ alloy having a major axis length of 45 nm and an aspect ratio of 1.5, and a dielectric material of polyethylene, are weighed to provide amounts of the needle-shaped magnetic particles and the polyethylene of 30 volume % and 70 volume %, respectively, based on a total amount of the needle-shaped magnetic particles and the dielectric material. A dispersing agent and a coupling agent are added to the needle-shaped magnetic particles and the dielectric material in suitable amounts and kneaded using a mixing roll (No191-TM/WM) manufactured by Yasda Machine.

The kneading is performed until the needle-shaped magnetic particles are uniformly mixed in the polyethylene while heating the materials at 140° C.

Subsequently, the obtained material mixture is added to a mold heated at 180° C. and molded with a pressure of 35 megapascals (MPa) to provide a magnetic composite material according to Example 1.

Example 2

Each magnetic composite material according to Examples 2 to 6 and Comparative Examples 1 to 3 is prepared in accordance with the same procedure as in Example 1, except that the aspect ratio is changed as provided in Table 1.

In order to measure the high frequency characteristics of magnetic composite materials according to Examples 1 to 6 and Comparative Examples 1 to 3, the magnetic composite materials according to Examples 1 to 6 and Comparative Examples 1 to 3 are cut to provide a toroidal sample having an outer diameter of (ϕ) 7 millimeters (mm) and a thickness of 2 mm.

The high frequency characteristics are measured by the following method.

Method of Measuring Magnetic Permeability

Using the obtained toroidal samples according to Examples 1 to 6 and Comparative Examples 1 to 3, the high frequency characteristics are measured.

For the evaluation, a network analyzer (manufactured by Agilent, HP8753E) and an S parameter measurement jig having a coaxial tube (exterior diameter: 7 mm, interior diameter: 3 mm) are used.

Complex reflectance (S11) and complex transmittance (S21) parameters are measured in the measurement frequency band of 30 megahertz (MHz) to 6 GHz, and the complex permeability μr=μr'−jμr" is evaluated from the results using the S parameter method.

Table 1 shows the real part μ' of complex permeability at 3 GHz, the loss tangent tan δ (=μ"/μ'), and the resonance frequency fr defined by the peak position of μ" to the frequency in Examples 1 to 6 and Comparative Examples 1 to 3.

TABLE 1

| | Major axis length (nm) of magnetic particle diameter | Aspect ratio | Real Magnetic permeability μ' at 3 GHz | Loss tangent tan δ at 3 GHz | Resonance frequency fr (GHz) | Particle shape |
|---|---|---|---|---|---|---|
| Ex. 1 | 45 | 1.5 | 1.98 | 0.096 | >6 | Needle-shaped particle |
| Ex. 2 | 45 | 2 | 1.76 | 0.036 | >6 | |
| Ex. 3 | 45 | 4 | 1.24 | 0.032 | >6 | |
| Ex. 4 | 100 | 6 | 1.37 | 0.014 | >6 | |
| Ex. 5 | 110 | 4 | 1.56 | 0.054 | >6 | |
| Ex. 6 | 260 | 10 | 1.59 | 0.038 | >6 | |
| Comp. Ex. 1 | 45 | 1 | 2.20 | 0.192 | 5 | Sphere-shaped particle |
| Comp. Ex. 2 | 55 | 1 | 2.02 | 0.329 | 3 | |
| Comp. Ex. 3 | 75 | 1 | 1.70 | 0.432 | 2 | |

The results of Table 1 show that the magnetic composite material may be used for a high frequency electronic component.

Particularly, the magnetic composite material may be suitable for a high frequency electronic component in a communication device and an electronic device used in the gigahertz frequency domain.

While this disclosure has been described in connection with what is presently considered to be practical exemplary embodiments, it is to be understood that this disclosure is not limited to the disclosed embodiments, but, on the contrary, is intended to cover various modifications and equivalent arrangements included within the spirit and scope of the appended claims.

What is claimed is:

1. A magnetic composite material comprising:

a dielectric material; and magnetic metal particles in the dielectric material, wherein the magnetic metal particles comprise an iron-cobalt alloy, wherein the iron-cobalt alloy consists of iron and cobalt, wherein a real part μ' of a complex permeability of the magnetic composite material is greater than about 1 at a frequency of 3 gigahertz, and a loss tangent tan δ of the magnetic composite material is less than or equal to about 0.1, and wherein a magnetic metal particle of the magnetic metal particles has a needle shape and has an aspect ratio of about 1.5 to about 20, wherein the aspect ratio is a major axis length divided by a minor axis length.

2. The magnetic composite material of claim 1, wherein the real part μ' of the complex permeability is about 1 to about 5 at a frequency of about 3 gigahertz, and the loss tangent tan δ is about 0.01 to about 0.1.

3. The magnetic composite material of claim 1, wherein the real part μ' of the complex permeability is about 1 to about 3 at a frequency of about 3 gigahertz, and the loss tangent tan δ is about 0.01 to about 0.05.

4. The magnetic composite material of claim 1, wherein the magnetic metal particle has an aspect ratio of about 1.5 to about 15.

5. The magnetic composite material of claim 1, wherein a magnetic metal particle of the magnetic metal particles has a major axis length of about 10 to about 1000 nanometers.

6. The magnetic composite material of claim 5, wherein the magnetic metal particle has a major axis length of about 45 to about 260 nanometers.

7. The magnetic composite material of claim 1, wherein the magnetic metal particles consist of an iron-cobalt alloy.

8. The magnetic composite material of claim 1, wherein the iron-cobalt alloy is present in the magnetic metal particles in an amount of about 90 to about 95 parts by mass, based on 100 parts by mass of the magnetic metal particles.

9. The magnetic composite material of claim 1, wherein the iron-cobalt alloy consists of about 65 atomic percent to about 75 atomic percent iron, and about 25 atomic percent to about 35 atomic percent cobalt.

10. The magnetic composite material of claim 9, wherein the iron-cobalt alloy consists of about 70 atomic percent iron and about 30 atomic percent cobalt.

11. The magnetic composite material of claim 1, wherein the magnetic metal particles are randomly aligned.

12. The magnetic composite material of claim 1, wherein the dielectric material comprises an epoxy resin, a silicone, a phenolic resin, a polyimide, a polybenzoxazole, a polyphenylene, a polybenzocyclobutene, a polyarylene ether, a polycyclohexane, a polyester, a fluoropolymer, a polyolefin, a polycycloolefin, a polycyanate, a polyphenylene ether, a polystyrene, a polyethylene, or a combination thereof.

13. The magnetic composite material of claim 1, wherein the dielectric material is polyethylene.

14. The magnetic composite material of claim 1, wherein the magnetic metal particles is included in an amount of about 25 volume percent to about 35 volume percent, and the dielectric material is included in an amount of about 65 volume percent to about 75 volume percent, each based on a total volume of the magnetic metal particles and the dielectric material.

15. The magnetic composite material of claim 14, wherein the magnetic metal particles are included in an amount of about 30 volume percent and the dielectric material is included in an amount of about 70 volume percent, each based on a total content of the magnetic metal particles and the dielectric material.

16. A method of manufacturing a magnetic composite material, the method comprising:

contacting magnetic metal particles and a dielectric material to form a dispersion of the magnetic metal particles in the dielectric material to manufacture the magnetic composite material, wherein the magnetic metal particles comprise an iron-cobalt alloy, wherein the iron-cobalt alloy consists of iron and cobalt, wherein a real part μ' of a complex permeability of the magnetic composite material is greater than about 1 at a frequency of 3 gigahertz, and a loss tangent tan δ of the magnetic composite material is less than or equal to about 0.1, and wherein a magnetic metal particle of the magnetic metal particles has a needle shape and has an aspect ratio of about 1.5 to about 20, wherein the aspect ratio is a major axis length divided by a minor axis length.

17. An electronic device comprising the magnetic composite material of claim 1.

18. A method of providing a material having a selected complex permeability and a selected loss tangent of a magnetic composite material, wherein a real part μ' of a complex permeability of the magnetic composite material is greater than about 1 at a frequency of 3 gigahertz, and a loss tangent tan δ of the magnetic composite material is less than or equal to about 0.1, wherein a magnetic metal particle of the magnetic metal particles has an aspect ratio of about 1.5 to about 20, wherein the aspect ratio is a major axis length divided by a minor axis length, the method comprising:

selecting a magnetic metal particle comprising an iron-cobalt alloy, wherein the iron-cobalt alloy consists of iron and cobalt, and having a needle shape having an aspect ratio of about 1.5 to about 20, wherein the aspect ratio is a major axis length divided by a minor axis length; and combining the magnetic metal particle with a dielectric material to provide a material having a complex permeability and a loss tangent of the magnetic composite material wherein a real part μ' of a complex permeability of the magnetic composite material is greater than about 1 at a frequency of 3 gigahertz, and a loss tangent tan δ of the magnetic composite material is less than or equal to about 0.1.

* * * * *